US009659723B2

(12) United States Patent
Yabe et al.

(10) Patent No.: US 9,659,723 B2
(45) Date of Patent: May 23, 2017

(54) ACCESSORY CONTROLLER WITH SWITCH MODULE

(75) Inventors: Osamu Yabe, Sunnyvale, CA (US); Craig M. Stanley, Campbell, CA (US); Kurt R. Stiehl, San Jose, CA (US); Christopher D. Prest, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 505 days.

(21) Appl. No.: 13/478,623

(22) Filed: May 23, 2012

(65) Prior Publication Data

US 2013/0313097 A1 Nov. 28, 2013

(51) Int. Cl.
*H01H 13/14* (2006.01)
*H01H 13/705* (2006.01)

(52) U.S. Cl.
CPC ..... *H01H 13/705* (2013.01); *H01H 2229/044* (2013.01); *H01H 2233/002* (2013.01)

(58) Field of Classification Search
CPC H01H 13/14; H01H 5/00; H01H 9/00; H01H 11/00; H01H 13/00; H01H 2003/00; H01H 2003/007; H01H 2011/00; H01H 2011/0081; H01H 2233/00; H01H 2223/002; H01H 2223/003; H01H 2233/044; H01H 2229/044; H01H 2229/046; H01H 2229/047; H01H 2229/048; H01H 2229/05; H01H 2229/052; H01H 2231/022; H01H 2231/032; H01H 2231/036; H01H 2300/014; H01H 13/70; H01H 1/10; H01H 9/0242; H01H 2217/018; H01H 2217/024; H01H 2239/03; H01H 2223/054; H01H 9/025; H01H 2237/004; H04H 1/10; Y10T 29/49885; Y10T 29/4998; Y10T 29/49904
USPC ..... 200/520, 513, 237, 238, 293, 293.1, 200/302.2, 302.3, 303, 329, 332.1, 332.2, 200/341; 264/255, 272.11, 272.14, 264/272.15, 279, 279.1, 4–4.7, 5, 478, 264/479, 529, 240, 294; 439/451, 455, 439/470; 174/650
See application file for complete search history.

(56) References Cited

U.S. PATENT DOCUMENTS 5,124,514 A * 6/1992 Chen ..... 200/533
5,226,904 A * 7/1993 Gentelia et al. ..... 606/42
5,684,272 A * 11/1997 Gernhardt ..... H01H 9/0228 174/650

(Continued)

*Primary Examiner* — Anthony R. Jimenez
(74) *Attorney, Agent, or Firm* — Brownstein Hyatt Farber Schreck, LLP

(57) ABSTRACT

An accessory may be provided with a button controller having a microphone and switches. Plastic structures for the accessory may be formed by injection molding. Plastic structures may be molded around switch terminals. Switches may be formed using dome switch members and the switch terminals. A printed circuit with components may be mounted in the plastic structures. Recesses in the structures may be configured to receive the dome switch members, components on the printed circuit board, and wires in a cable. A backplate may be used to cover the printed circuit. A layer of plastic may be molded over the backplate to seal an interface created by the backplate. Cable strain relief structures may be molded into the layer of plastic. A lip on the strain relief structures may prevent particles from entering the controller.

26 Claims, 24 Drawing Sheets

(56) References Cited

U.S. PATENT DOCUMENTS

| | | | | |
|---|---|---|---|---|
| 5,828,016 | A * | 10/1998 | Grannan et al. | 200/16 R |
| 7,687,734 | B2 | 3/2010 | Weber | |
| 7,758,787 | B2 * | 7/2010 | Grems et al. | 264/250 |
| 7,829,812 | B2 | 11/2010 | Tolbert et al. | |
| 7,902,474 | B2 | 3/2011 | Mittleman et al. | |
| 2005/0051416 | A1 * | 3/2005 | Mahoney | H01H 13/70 200/512 |
| 2009/0180643 | A1 | 7/2009 | Sander et al. | |
| 2010/0208933 | A1 * | 8/2010 | Lee et al. | 381/394 |
| 2011/0194710 | A1 | 8/2011 | Prest et al. | |
| 2011/0319892 | A1 * | 12/2011 | Blomeyer | 606/42 |
| 2012/0148052 | A1 * | 6/2012 | Adam | H01R 13/66 381/1 |

* cited by examiner

ACCESSORY CONTROLLER WITH SWITCH MODULE

BACKGROUND

This relates to electronic devices, and more particularly, to accessories for electronic devices.

Electronic devices such as computers, media players, and cellular telephones typically contain user interface components that allow these devices to be controlled by a user. It is sometimes desirable to add accessories to electronic devices. For example, a user may desire to plug a headset or adapter accessory into an electronic device to allow the user to listen to audio.

Headsets are sometimes provided with buttons and microphones. A headset microphone may be used to pick up a user's voice during a telephone call. Buttons may be used to control media file playback, to make volume level adjustments during a telephone call, and to issue other commands for the electronic device. Buttons and a microphone may be mounted within a button controller assembly. Microphone signals and button signals may be routed from the button controller assembly to an electronic device using wires in the headset.

The designers of accessories and other electronic equipment are challenged with designing parts that are not overly complex or costly and that exhibit satisfactory reliability and performance It would therefore be desirable to provide improved electronic device accessories such as accessories with button controller and microphone assemblies.

SUMMARY

An accessory may be provided with a button controller. The button controller may have a switch module that contains switches and a microphone. The switches may be formed from dome switch members. The microphone and other electrical components may be mounted within plastic structures.

The plastic structures may be formed using injection molding operations. For example, switch terminals for the switches may be formed by molding plastic around switch terminal structures. Switches may then be formed using dome switch members and the switch terminals.

A printed circuit with components may be mounted within the plastic structures. Recesses in the structures may be configured to receive the dome switch members, components on the printed circuit board, and wires in a cable. A backplate may be used to cover the printed circuit. A layer of plastic may be molded over the backplate to seal an interface created by the backplate. Cable strain relief structures may be molded into the layer of plastic.

Further features of the invention, its nature and various advantages will be more apparent from the accompanying drawings and the following detailed description of the preferred embodiments.

DETAILED DESCRIPTION

Electronic components such as microphones and buttons may be used in a wide range of applications. For example, microphones and buttons may be used to form a button controller for a headset or other accessory. Button structures and microphone structures may, in general, be used in any suitable system. Button controller assemblies that are suitable for use in accessories such as electronic device headsets are sometimes described herein as an example.

Figure 1:
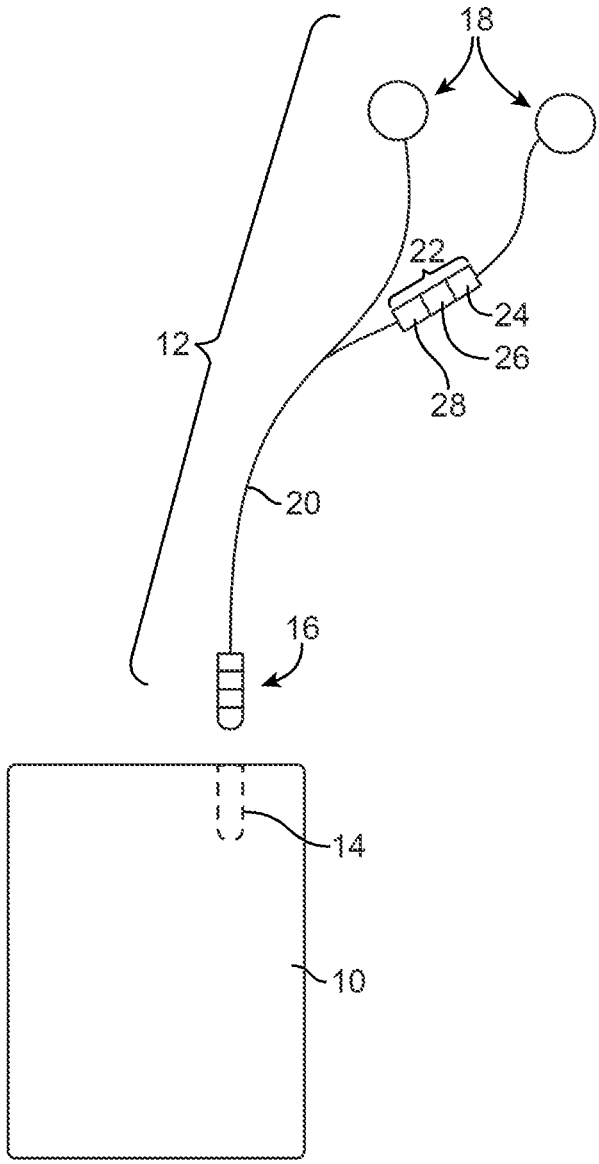
FIG. 1 is a diagram of a system including an electronic device and associated accessory in accordance with an embodiment of the present invention.

An illustrative system in which an accessory may be used with an electronic device is shown in FIG. 1. As shown in FIG. 1, electronic device 10 may be coupled to an accessory such as headset 12 by plugging plug 16 of accessory 12 into jack 14 of electronic device 10.

Electronic device 10 may be a computer such as a desktop computer, tablet computer, or laptop computer. Device 10 may also be a handheld electronic device such as a cellular telephone or media player, a tablet device, other portable electronic devices, or any other electronic equipment. Headset 12 may have speakers 18 and controller 22. Controller 22 may have buttons and may therefore sometimes be referred to as a button controller or button controller assembly. Button controller 22 and speakers 18 may be coupled to device 10 using cable 20 (e.g., a three-wire or four-wire headset cable). Button controller 22 may, if desired, include a microphone. The microphone may be used by a user of device 10 and headset 12 during a telephone call (e.g., to pick up the user's voice).

Button controller 22 may include buttons such as buttons 24, 26, and 28. There may, in general, be any suitable number of buttons in button controller 22 (e.g., one or more buttons, two or more buttons, three or more buttons, etc.). With one suitable arrangement, which is sometimes described herein as an example, button controller 22 may include three buttons. These buttons may be used to issue commands for device 10. Examples of commands that may be issued for device 10 using the buttons of button controller assembly 22 include stop, forward, and reverse commands, volume up and down commands, telephone call control commands, etc.

Figure 2:
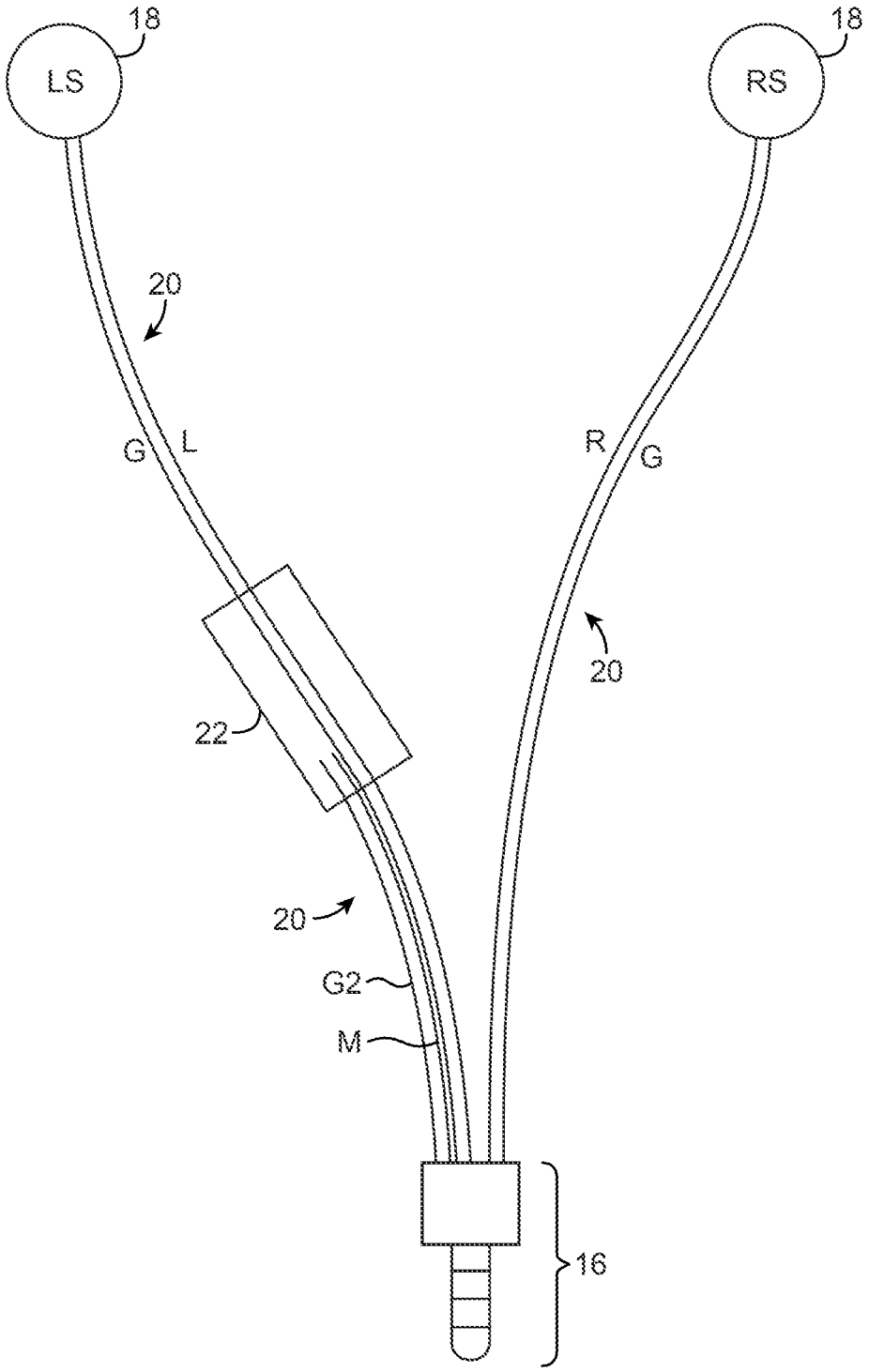
FIG. 2 is a wiring diagram for an illustrative accessory such as a pair of headphones with a button controller that has switches and a microphone in accordance with an embodiment of the present invention.

A wiring diagram of an illustrative accessory such as headset 12 of FIG. 1 is shown in FIG. 2. As shown in FIG. 2, headset 12 may have wires in cables 20 that interconnect left speaker 18 (LS), right speaker 18 (RS), plug 16, and button controller 22. Two ground lines (G and G2) may be coupled to a ground terminal in plug 16. A microphone line (M), left speaker line (L), and right speaker line (R) may be coupled to a microphone terminal, left speaker terminal, and right speaker terminal in plug 16, respectively. Ground line G2 and microphone line M may terminate on terminals in button controller 22. Ground line G and speaker line L may pass through the housing of button controller 22 to couple to speaker terminals in left speaker LS. Right speaker RS may have terminals that are coupled between right speaker line R and ground speaker line G.

Figure 3:
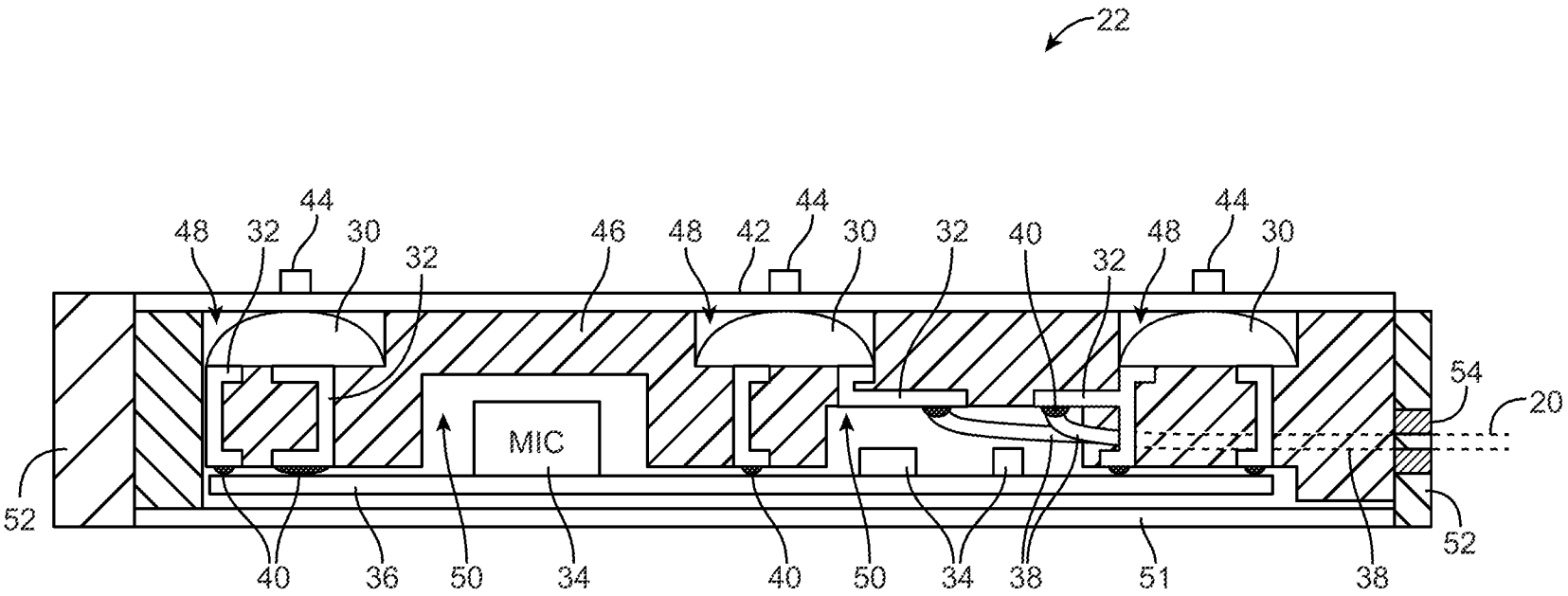
FIG. 3 is a cross-sectional side view of an illustrative button controller assembly for an accessory in accordance with an embodiment of the present invention.

A cross-sectional side view of structures in button controller 22 is shown in FIG. 3. As shown in FIG. 3, button controller 22 may have a dome switches formed from dome switch members such as dome switch members 30. Each dome switch member may contact portions of terminal structures such a terminal structures 32. Terminal structures 32 may be formed from metal and may be soldered to circuitry such as components 34 on printed circuit board 36 and to wires such as wires 38 in cable 20 using solder 40. Dome switch members 30 may be received within recesses in plastic structure 46. During operation, dome switch members 30 may be compressed by a user. When a dome switch member is compressed in this way, metal on the dome switch member can short together a corresponding pair of switch terminal structures (i.e., each dome switch is formed from a corresponding dome switch member 30 and portions of associated terminals structures 32).

Flexible plastic sheet 42 may cover dome switch members 30. Structures 44 may be formed from a material such as epoxy and may be used to create a structure against which an overlying plastic button member may bear when actuating the switches formed by dome switch members 30. Plastic structure 46 may have upper recesses such as dome switch member recesses 48 for receiving dome switch members 30 and may have lower recesses such as lower recesses 50 for receiving components such as a microphone (MIC) and other electrical components 34 on printed circuit board 36. A planar member such as a sheet of plastic or metal such as backplate 51 may be used to cover recesses such as recesses 50 on the rear of structures 46.

Multiple injection-molded plastic structures (sometimes referred to as "shots" of plastic) may be used in forming button controller structures. For example, a shot of plastic may be used in forming plastic structure 46 and a shot of plastic may be used in forming additional structures such as structure 52. Wires 38 may be secured within a groove in a plastic structure such as structure 52 using adhesive 54 or other suitable attachment mechanisms.

Figure 4:
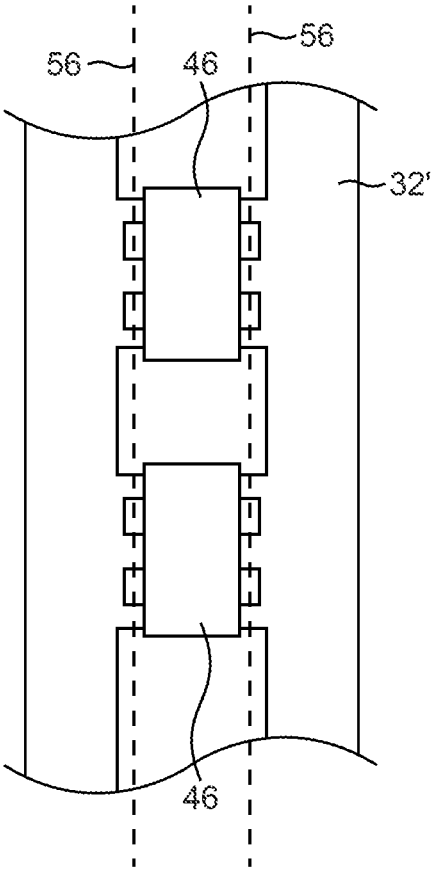
FIG. 4 is a top view of switch terminal structures for a button controller assembly in accordance with an embodiment of the present invention.

Switch terminals such as terminals 32 may be formed from a patterned metal part. FIG. 4 is a top view of switch terminal structures 32' for a button controller assembly. As shown in FIG. 4, switch terminal structures 32' may form a frame for holding switch terminals in place during injection molding of plastic structures 46. Following injection molding of plastic structures 46 over the metal that forms switch terminals 32 of FIG. 3, exterior portions of structures 32' may be removed from the portions of structures 32' that lie within structures 46. For example, structures 32' may be cut along lines 56, leaving terminal structures 32 embedded within structures 46.

The interior components of button controller 22 that are used in forming switches and associated mounting structures may sometimes be referred to as switch module structures or a switch module. A switch module for button controller 22 may be formed by injection molding multiple plastic structures onto each other. Illustrative operations involved in forming a switch module using injection molding techniques are shown in FIGS. 5, 6, 7, 8, and 9.

Figure 5:
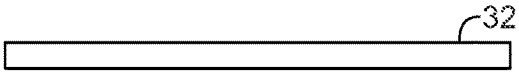
FIG. 5 is a side view of switch terminal structures prior to injection molding of plastic structures in accordance with an embodiment of the present invention.

Initially, as shown in FIG. 5, switch terminal structures 32 may be formed (e.g., by stamping, machining, or otherwise patterning a sheet of metal or other suitable conductive material).

Figure 6:
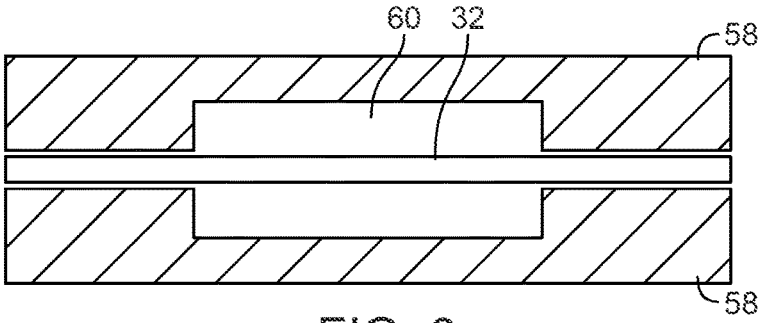
FIG. 6 is a cross-sectional side view of the switch terminal structures of FIG. 5 in an insert molding tool in accordance with an embodiment of the present invention.

As shown in FIG. 6, metal parts for forming switch terminals structures 32 may be placed in cavity 60 of molding tool 58.

Figure 7:
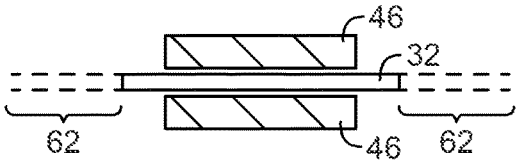
FIG. 7 is a cross-sectional side view of the switch terminal structures of FIG. 6 following insert molding of a first shot of plastic and removal of excess terminal structure material in accordance with an embodiment of the present invention.

During a first injection molding operation, plastic (e.g., a first shot of plastic) may be injection molded into cavity 60 over the switch terminal structures to form injection-molded (insert-molded) plastic structures such as structures 46 of FIG. 7. Portions 62 of the terminal structures may then be removed to form terminal structures 32 of FIG. 8 (e.g., by stamping, sawing, breaking, or other suitable techniques).

Figure 8:
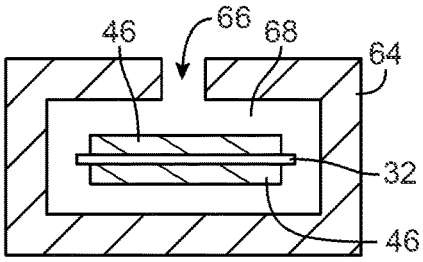
FIG. 8 is a cross-sectional side view of the switch terminal structures of FIG. 7 in an insert molding tool in accordance with an embodiment of the present invention.

Following removal of plastic structures 46 from injection molding tool 58, structures 46 (and embedded switch terminal structures 32) may be placed in a different mold cavity, such as mold cavity 68 in injection molding tool 64 of FIG. 8. Molding tool 64 may be formed using different equipment from tool 58 or tools 64 and 58 may be part of the same system. During a second injection molding operation, a second shot of plastic may be injected into mold cavity 68 (e.g., via injection port 66), as shown in FIG. 8.

Figure 9:
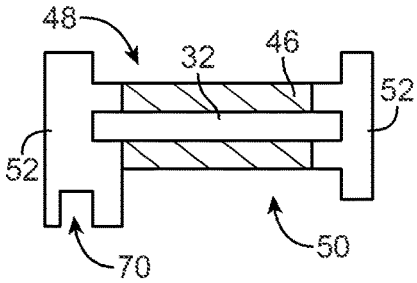
FIG. 9 is a cross-sectional side view of the switch terminal structures of FIG. 8 following insert molding of a second shot of plastic in accordance with an embodiment of the present invention.

The second injection molding operation may be used to form a plastic structure such as plastic structure 52 on structures 32 and 46, as shown in FIG. 9. If desired, structures 52 may include recesses or other features for receiving components as part of a button controller assembly process. As an example, structures 52 may include a recess such as recess 70 (e.g., a groove) for receiving wires in cable 20. Structures 52 may also include lower recesses such as recess 50 for receiving components 34 (FIG. 3), features for forming recesses for receiving switch components, etc.

Figure 10:
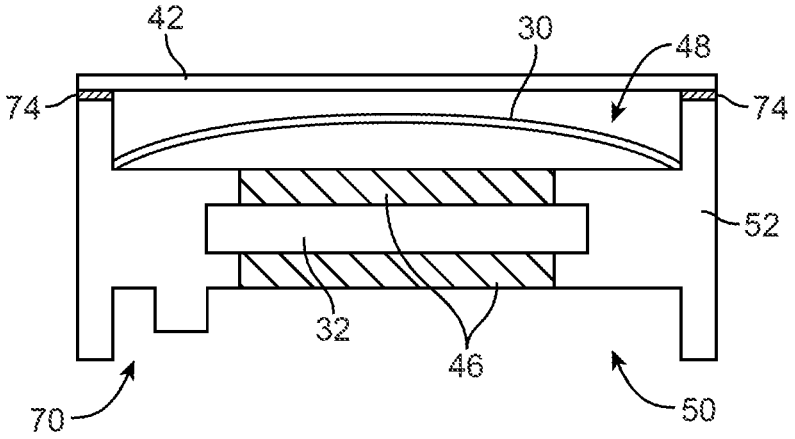
FIG. 10 is a cross-sectional side view of a partially assembled button controller assembly that has been provided with a dome switch member in accordance with an embodiment of the present invention.
Figure 11:
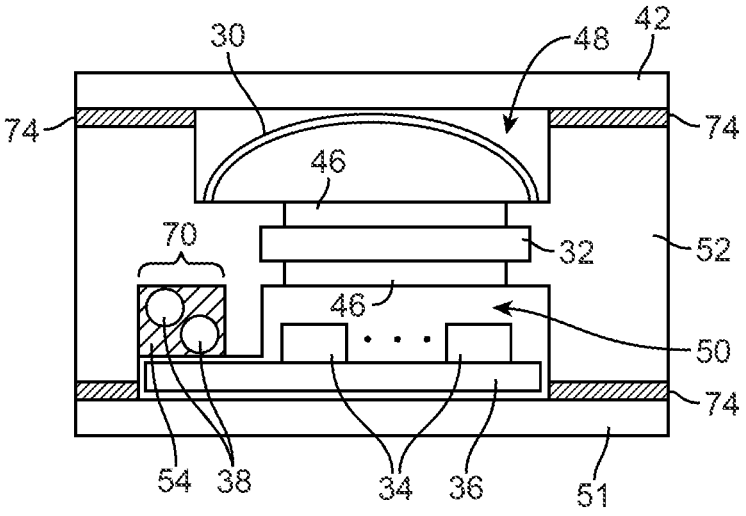
FIG. 11 is a cross-sectional side view of the structures of FIG. 10 following attachment of a printed circuit with components, wires, a backplate, and a flexible button cover layer in accordance with an embodiment of the present invention.

FIG. 10 shows how a switch component such as dome switch member 30 may be placed in recess 48. Recess 48 may be formed in structures 46 and/or 52 or other plastic switch module structures. Portions of switch terminals 32 may contact metal in dome switch members 30 during operation. By using a second shot of plastic such as shot 52, these portions of metal may be environmentally sealed. The recesses in which dome switch members 30 are received may be sealed using a plastic sheet. For example, a cover layer such as flexible plastic sheet 42 may be attached to structure 52 over dome switch members 30 using adhesive 74. FIG. 11 shows how wires 38 may be secured in groove 70 using adhesive 54. Components 34 on printed circuit 36 may be received within recess 50. Backplate 51 may be attached to structures 52 using adhesive 74, thereby enclosing printed circuit 36 and components 34.

The structures of FIG. 11 may form a switch module for button controller 22. A cover member and rear housing member may be used as housing structures to enclose the switch module. A strain relief structure may be used to hold cable 20 to the button controller. To prevent external material such as dust particles from entering into the interior of button controller 22, the strain relief structure and/or other structures in button controller 22 may be provided with particle blocking features such as flexible lip structures.

Figure 12:
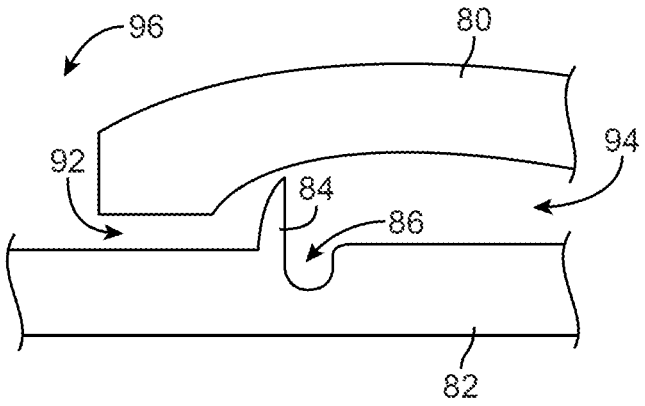
FIG. 12 is a cross-sectional side view of a portion of a strain relief structure for a switch module that has a barrier member for blocking material from entering the interior of the switch module in accordance with an embodiment of the present invention.

As an example, consider the cross-sectional side view of button member 80 and strain relief member 82 of FIG. 12. Strain relief member 82 may be formed from an elastomeric plastic that is configured to provide strain relief to cable 20. Button member 80 may serve as a cover structure that covers the structures of the switch module of FIG. 11. When pressed inwardly by a user (down in the orientation of FIG. 12), button member 80 may actuate a corresponding one of the dome switches formed using dome switch members 30. Button member 80 may be formed from a plastic that is sufficiently flexible to ensure that the operation of pressing one button member does not inadvertently actuate adjacent switches. During operation, button member 80 may move between an unactuated position (when not pressed by a user) and an actuated position (when pressed downwards towards underlying switches by a user).

As shown in FIG. 12, in its unactuated position, button member 80 may not be perfectly flush with the surface of strain relief structure 82. As a result, there is a potential for debris to enter into interior region 94 of button controller 22 from exterior region 96 through gap 92. To prevent material from entering into region 94 through gaps such as gap 92, strain relief structure 82 or other suitable button controller structures may be provided with a protruding structure such as flexible lip 84. A protrusion such as flexible lip 84 may be formed from a material with sufficient elasticity to bend when button member 80 is pressed and bears against lip 84. Recess 86 in strain relief structure 82 may help allow lip structure 84 to deform.

Figure 13:
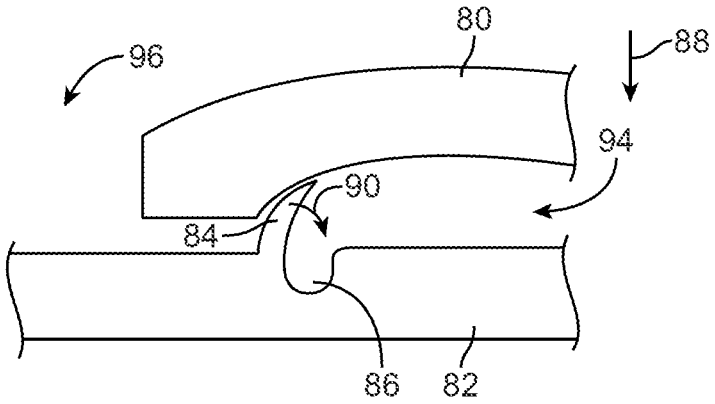
FIG. 13 is a cross-sectional side view of the portion of the strain relief structure of FIG. 12 following pressing of a button member that compresses a flexible portion of the barrier member in accordance with an embodiment of the present invention.

As shown in FIG. 13, when button member 80 is pressed downwards in direction 88 by a user, lip 90 may bend in direction 90. The presence of recess 86 may help accommodate bending lip structure 84. In both the unactuated position of FIG. 12 and the actuated position of FIG. 13, lip 84 may touch (or nearly touch) member 80, thereby helping to block debris and forming a seal between exterior region 96 and interior region 94.

Figure 14:
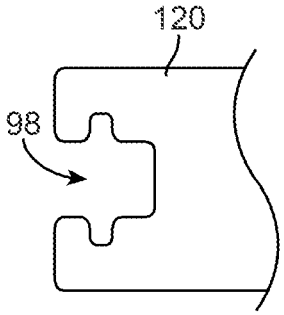
FIG. 14 is a cross-sectional view of a portion of a switch module structure in accordance with an embodiment of the present invention.
Figure 15:
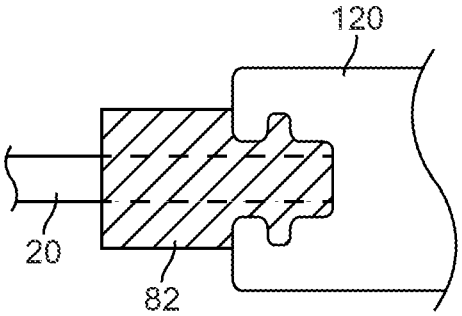
FIG. 15 is a cross-sectional view of the button controller member of FIG. 14 following insertion molding of a strain relief member into the switch module structure and around a cable with wires in accordance with an embodiment of the present invention.

FIG. 14 is a top view of an end portion of plastic button controller structures such as plastic molded structure 120 showing how a recess such as recess 98 may be formed to receive and engage an overmolded strain relief structure. As shown in FIG. 15, when a strain relief structure such as structure 82 has been formed, cable 20 may be held in place on button controller 22.

Figure 16:
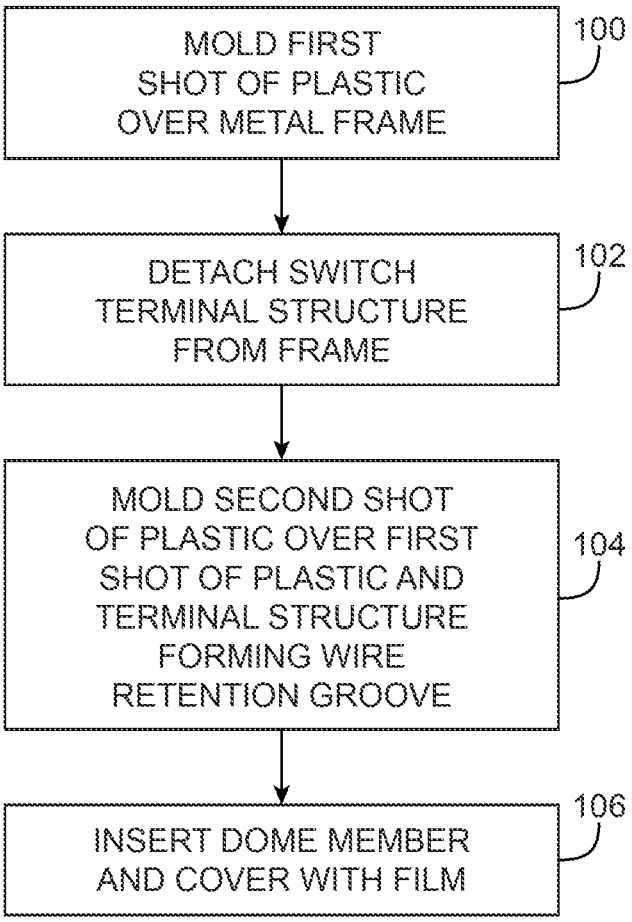
FIG. 16 is a flow chart of illustrative steps involved in assembling a switch module in accordance with an embodiment of the present invention.

FIG. 16 is a flow chart of illustrative steps involved in assembling a switch module for a button controller such as button controller 22. At step 100, an insert molding tool such as tool 58 of FIG. 6 may be used to mold plastic for structures 46 over a metal switch terminal structure such as structures for forming switch terminals 32 of FIG. 3. Tool 58 may have a mold cavity configured to form molded plastic structure 46 of FIG. 3. Terminal structures 32 may be held in place as part of a metal frame structure such as frame structure 32' of FIG. 4. Features such as dome switch member recesses 48 and component recesses 50 may, if desired, be incorporated into plastic structures 46.

At step 102, the switch terminal structures with the molded plastic may be removed from the remainder of the switch terminal structures (i.e., the switch terminal structures may be cut along lines 56 of FIG. 4 to release the individual switch terminal structures 32 from frame structures 32').

At step 104, a second shot of plastic may be overmolded on top of the first shot of plastic using an injection molding tool such as tool 64 of FIG. 8. During the operations of step 104, structures such as structures 52 from the second shot of plastic may be molded over structures such as structures 46 from the first shot of plastic (see, e.g., FIG. 9). Features such as wire retention groove 70 (FIG. 11) may be molded into structures 52 during the operations of step 104, if desired.

During the operations of step 106, switch module structures such as dome switch members 30 may be installed in recesses such as recesses 48 and polymer film 42 may be used to cover dome switch members 30 and recesses 48, thereby forming a switch module for use in button controller 22.

Following formation of the switch module, the switch module and additional button controller structures may be assembled to form a completed button controller in a headset or other accessory.

Figure 17:
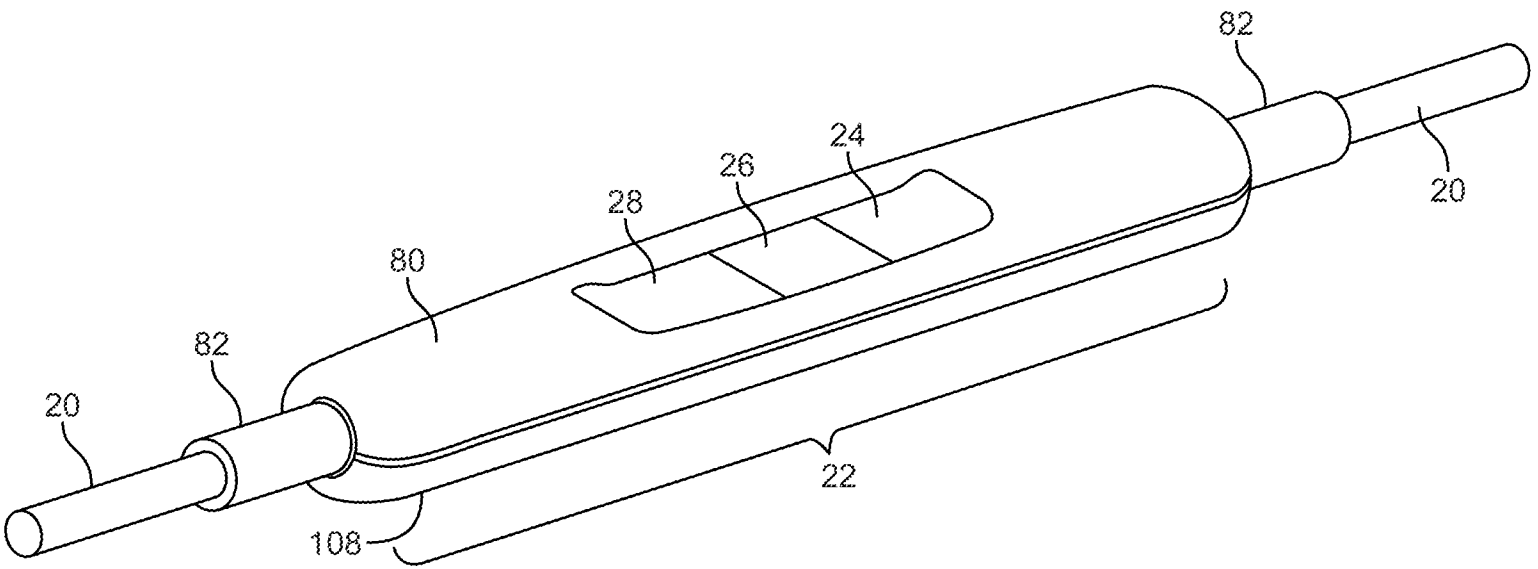
FIG. 17 is a perspective view of a button controller for an accessory in accordance with an embodiment of the present invention.

FIG. 17 is a perspective view of an illustrative button controller for an accessory. As shown in FIG. 17, button controller 22 may have a housing formed from lower housing member 108 and button member 80. Buttons such as buttons 28, 26, and 24 may be formed from flexible portions of member 80 overlapping corresponding switches in the switch module.

Figure 18:
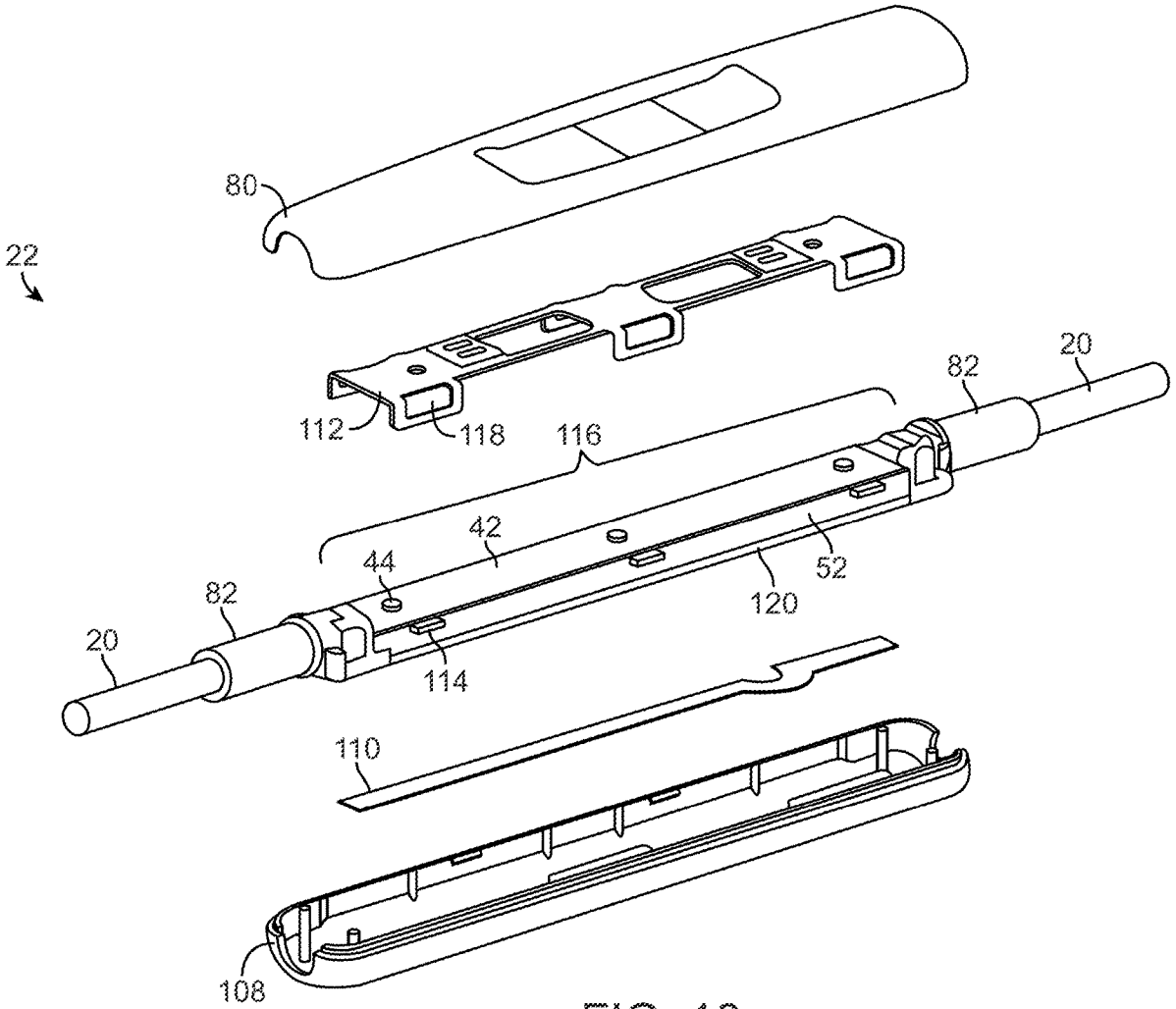
FIG. 18 is an exploded perspective view of a button controller in accordance with an embodiment of the present invention.

An exploded perspective view of button controller 22 is shown in FIG. 18. As shown in FIG. 18, button controller 22 may include a switch module such as switch module 116. Switch module 116 may be formed using operations of the type described in connection with FIG. 16. Switch module 116 may, for example, have dome switches that are covered with flexible plastic layer 42. Each dome switch may have a corresponding switch protrusion such as switch protrusion 44. Strain relief structures 82 may be used to help guide cable 20 into switch module 116.

Adhesive such as pressure sensitive adhesive 110 or other fastening mechanisms may be used to attach lower controller housing structure 108 to switch module 116. Metal clip 112 may be attached to button member 80 using heat stakes or other suitable attachment mechanisms. Clip 112 may have engagement features such as opening 118 that mate with corresponding engagement features on switch module 116 such as switch module protrusions 114 on plastic structure 52 (sometimes referred to as snaps).

Figure 19:
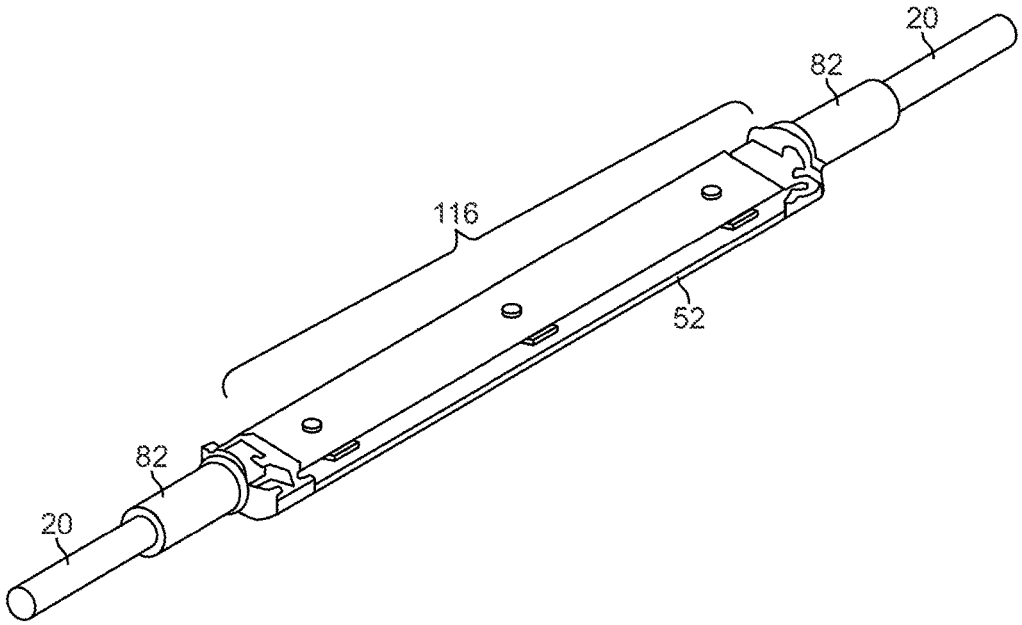
FIG. 19 is a perspective view of a switch module in a button controller following attachment of wire cables and strain relief structures in accordance with an embodiment of the present invention.

FIG. 19 is a perspective view of switch module 116 prior to assembly with the components of FIG. 18 to form button controller 22.

Figure 20:
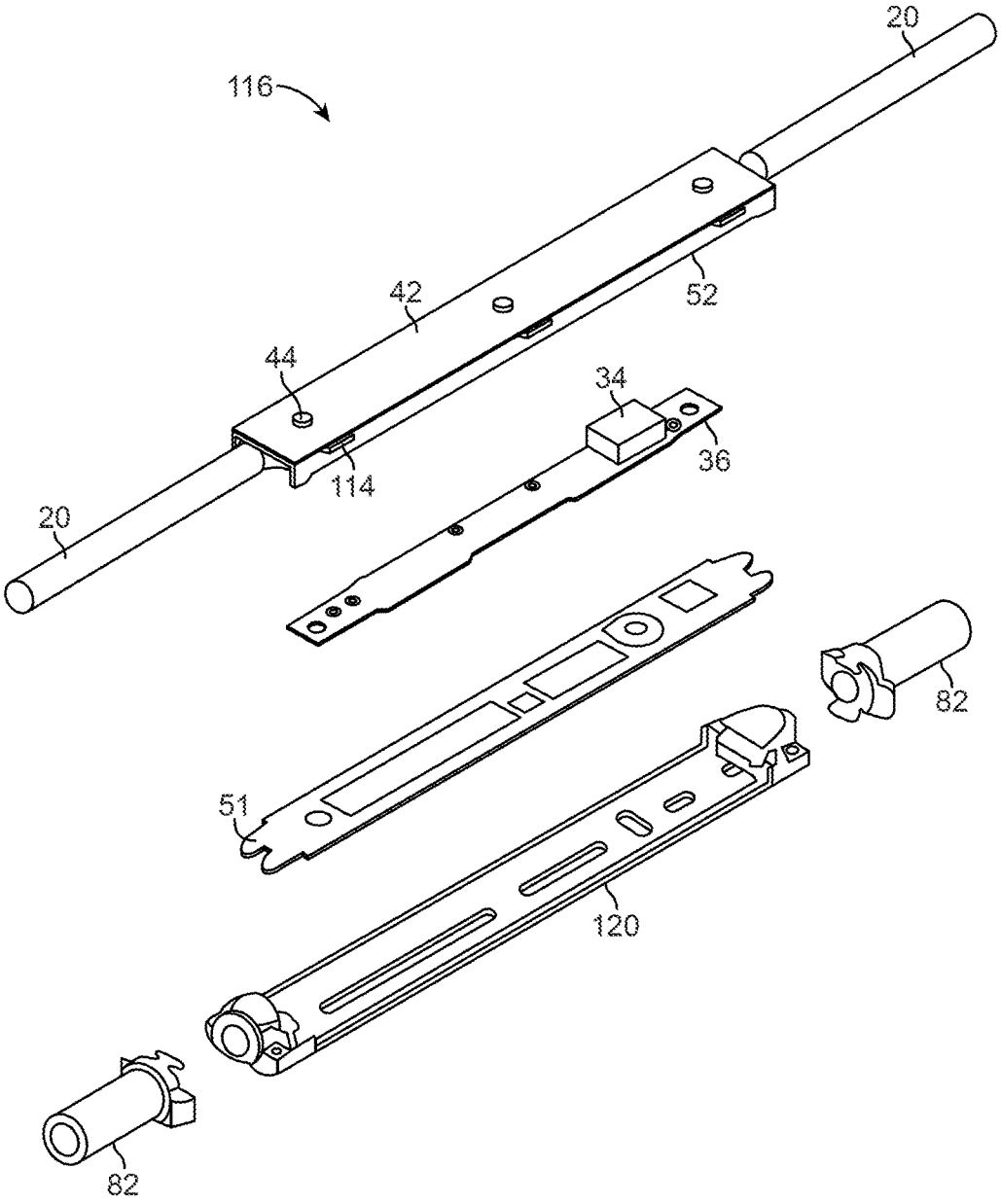
FIG. 20 is an exploded perspective view of a button controller in accordance with an embodiment of the present invention.

FIG. 20 is an exploded perspective view of a switch module such as switch module 116 of FIG. 19. As shown in FIG. 20, switch module 116 may include a printed circuit such as printed circuit 36. Printed circuit 36 may be a rigid printed circuit board such as a board formed from fiberglass-filled epoxy (e.g., an FR4 board) or may be a flexible printed circuit ("flex circuit") formed from a sheet of polyimide or other flexible polymer. Components such as components 34 may be mounted on printed circuit 36.

Switch module 116 of FIG. 20 may also include backplate 51. Plastic molded structure 120 may be formed from an additional shot of plastic (i.e., an overmolded structure formed from a third shot of plastic that covers the structures formed from first plastic shot 46 and second plastic shot 52). Molded structures 120 may cover backplate 51.

Figure 21:
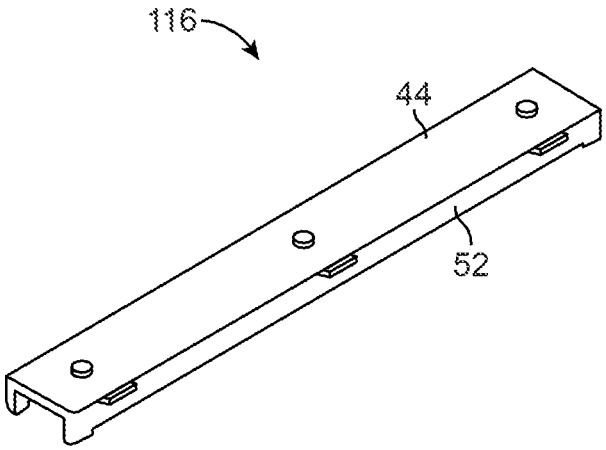
FIG. 21 is a perspective view of a switch module structure in accordance with an embodiment of the present invention.

FIG. 21 is a switch module structure formed from polymer film 44 that covers plastic structures such as structures 52 and 46.

Figure 22:
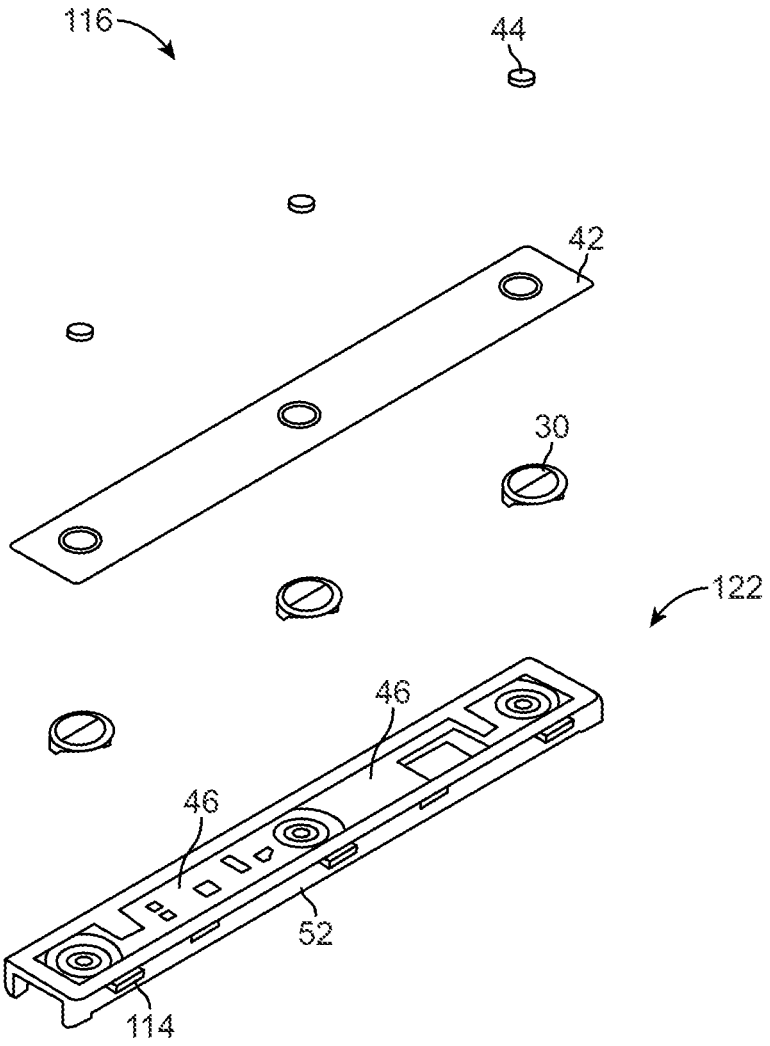
FIG. 22 is an exploded perspective view of switch module structures in accordance with an embodiment of the present invention.

FIG. 22 is a front exploded perspective view of switch module structures in switch module 116. As shown in FIG. 22, switch module 116 may include protruding portions (e.g., epoxy structures) on polymer film 42, underlying dome switch members 30, and structures 122 for receiving dome switch members 30. Structures 122 may include structures 46 and structures 52.

Figure 23:
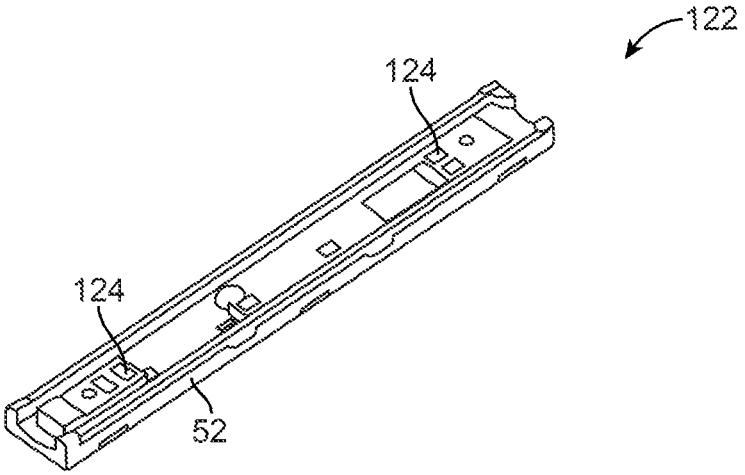
FIG. 23 is a rear perspective view of a switch module structure in accordance with an embodiment of the present invention.

FIG. 23 is a rear perspective view of switch module structures 122, showing how structures 122 may have exposed terminals such as terminals 124 that are accessible through openings in plastic structure 52.

Figure 24:
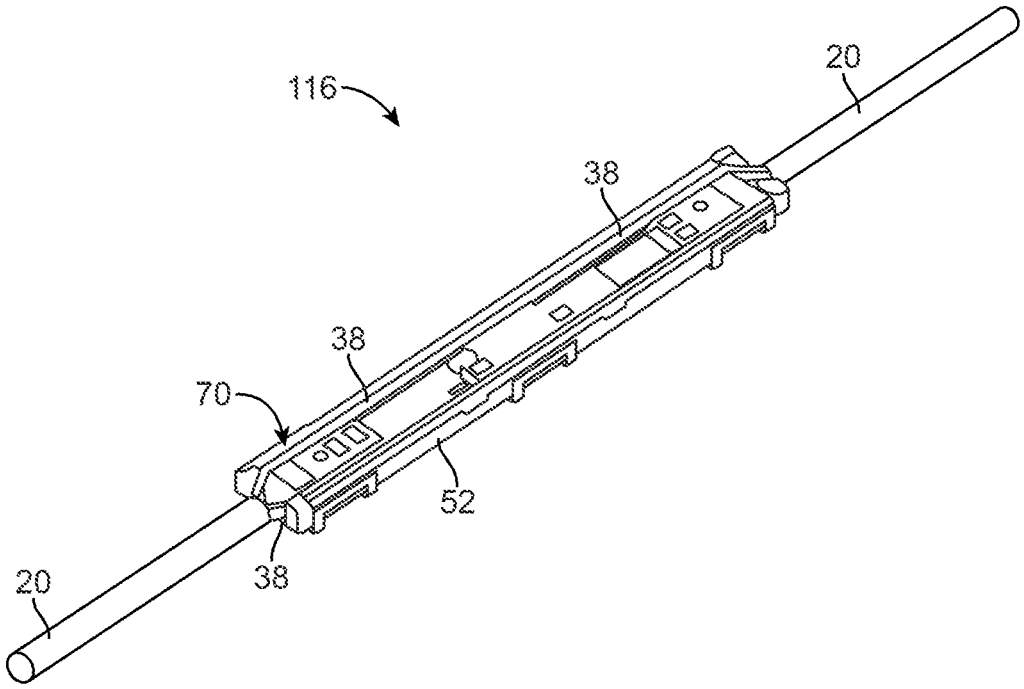
FIG. 24 is a rear perspective view of the switch module structure of FIG. 23 following attachment of wires in accordance with an embodiment of the present invention.

FIG. 24 is a rear perspective view of the switch module structure of FIG. 23 showing how wires 38 may be press fit into groove 70 in plastic structure 52. Bare ends of the G2 and M wires (FIG. 2) may be soldered to switch terminal structures 32.

Figure 25:
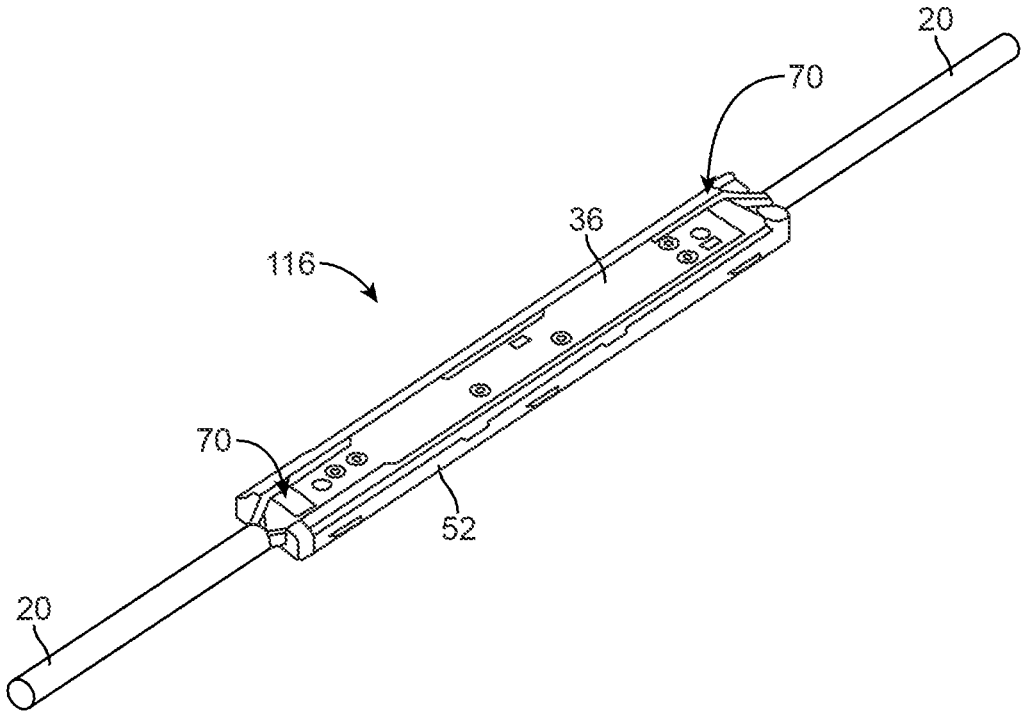
FIG. 25 is a rear perspective view of the switch module structures of FIG. 24 following attachment of a printed circuit board in accordance with an embodiment of the present invention.

FIG. 25 is a rear perspective view of the switch module structures of FIG. 24 following attachment of printed circuit 36. Solder may be used to electrically connect circuitry on printed circuit 36 to switch terminal structures 32. A heated tool (e.g., a hot bar structure) or other equipment may be used to reflow the solder used in connecting printed circuit 36 to switch terminal structures 32.

Figure 26:
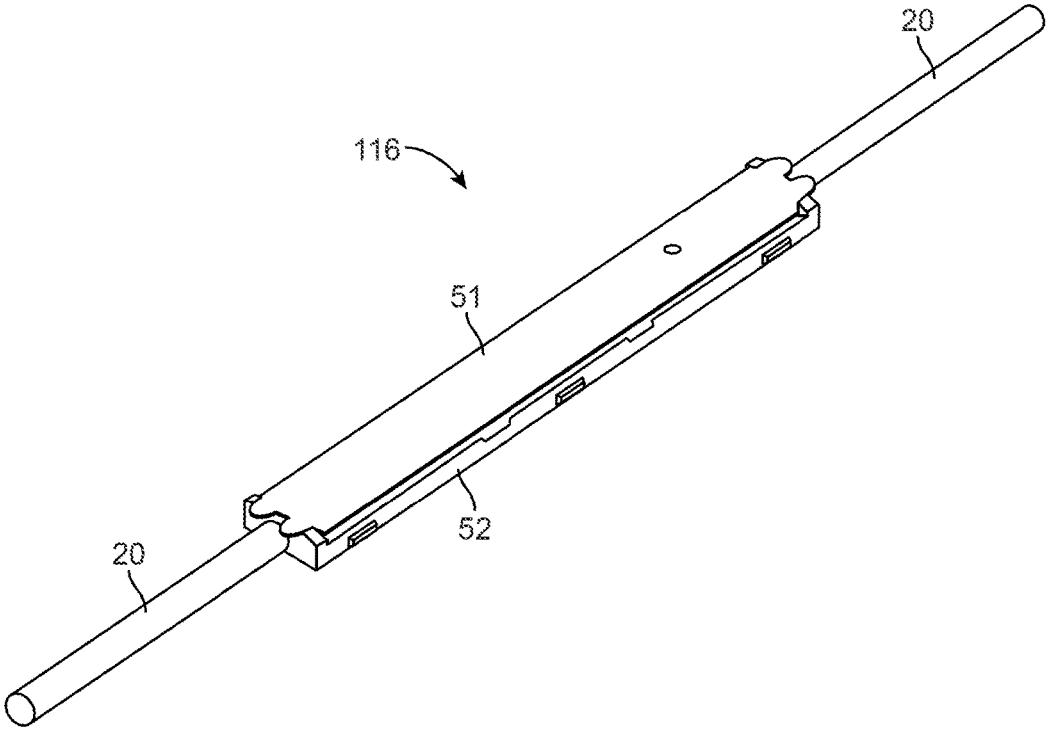
FIG. 26 is a rear perspective view of the switch module structures of FIG. 25 following attachment of a backplate structure over the printed circuit board in accordance with an embodiment of the present invention.

Following attachment of printed circuit 36, backplate 51 may be attached to switch module structures 116, as shown in the rear perspective view of the switch module structures in FIG. 26.

Figure 27:
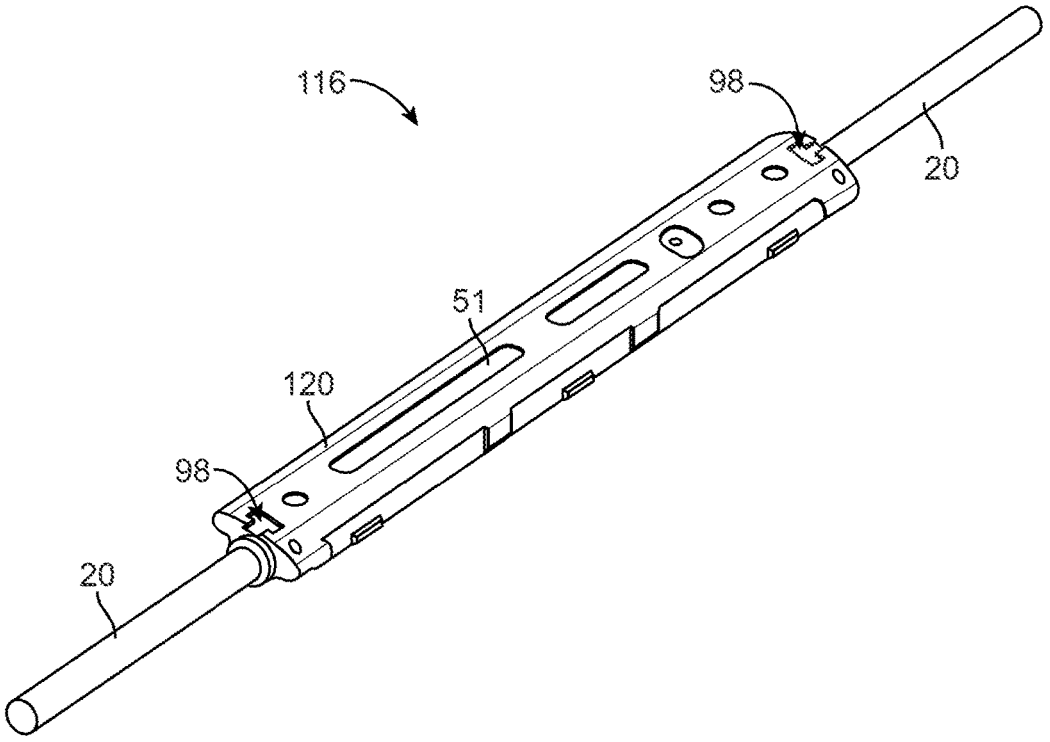
FIG. 27 is a rear perspective view of the switch module structures of FIG. 26 following overmolding of a shot of plastic in accordance with an embodiment of the present invention.

FIG. 27 is a rear perspective view of the switch module structures of FIG. 26 following overmolding of a shot of plastic to form overmold structures 120. Portions of backplate 51 may be visible through openings in structures 120. Overmolded structures 120 may help seal the interface between backplate 51 and plastic structures 52 (FIG. 26). Overmold 120 may also retain wires 22 and cable 20 and may cover recess 70.

Figure 28:
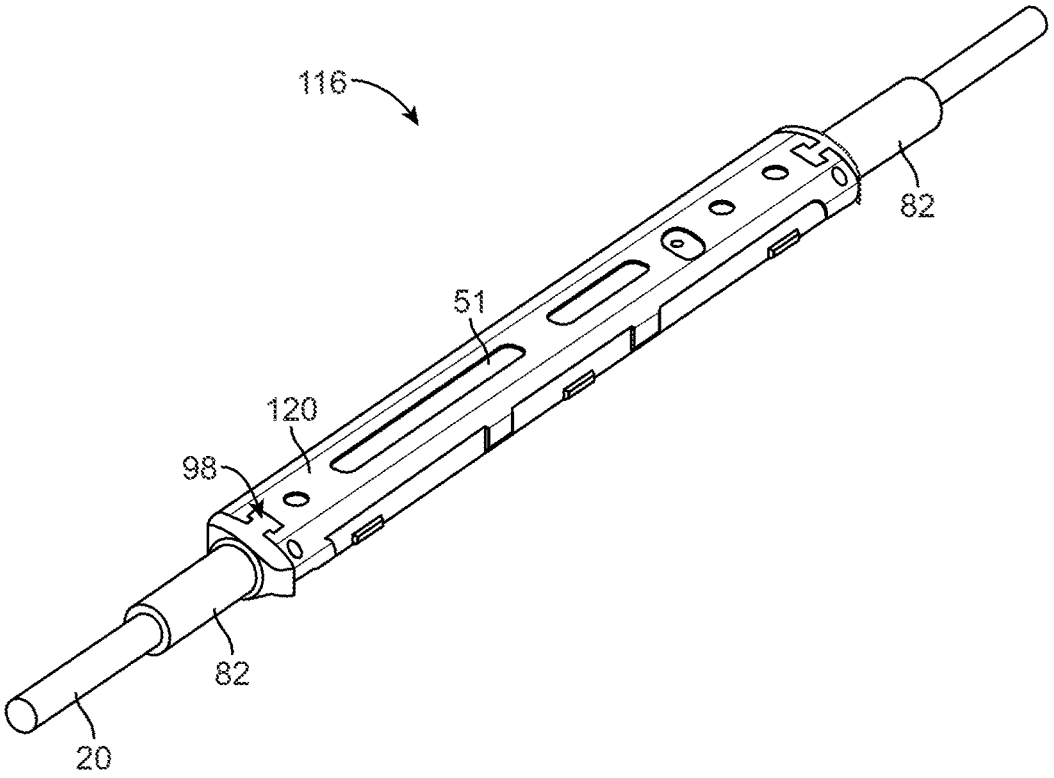
FIG. 28 is a rear perspective view of the switch module structures of FIG. 27 following injection molding of a shot of plastic for a strain relief structure in accordance with an embodiment of the present invention.

FIG. 28 is a rear perspective view of the switch module structures of FIG. 27 following injection molding of a shot of plastic to form strain relief structures 82. The plastic material used to form strain relief structures 82 may be, for example, a soft elastomeric material such as thermoplastic polyurethane. Illustrative materials for forming the other plastic structures in button controller 22 include polycarbonate (PC), acrylonitrile butadiene styrene (ABS), PC/ABS blends, polypropylene, and other moldable plastics (as examples). Other types of plastic may be used, if desired.

Figure 29:
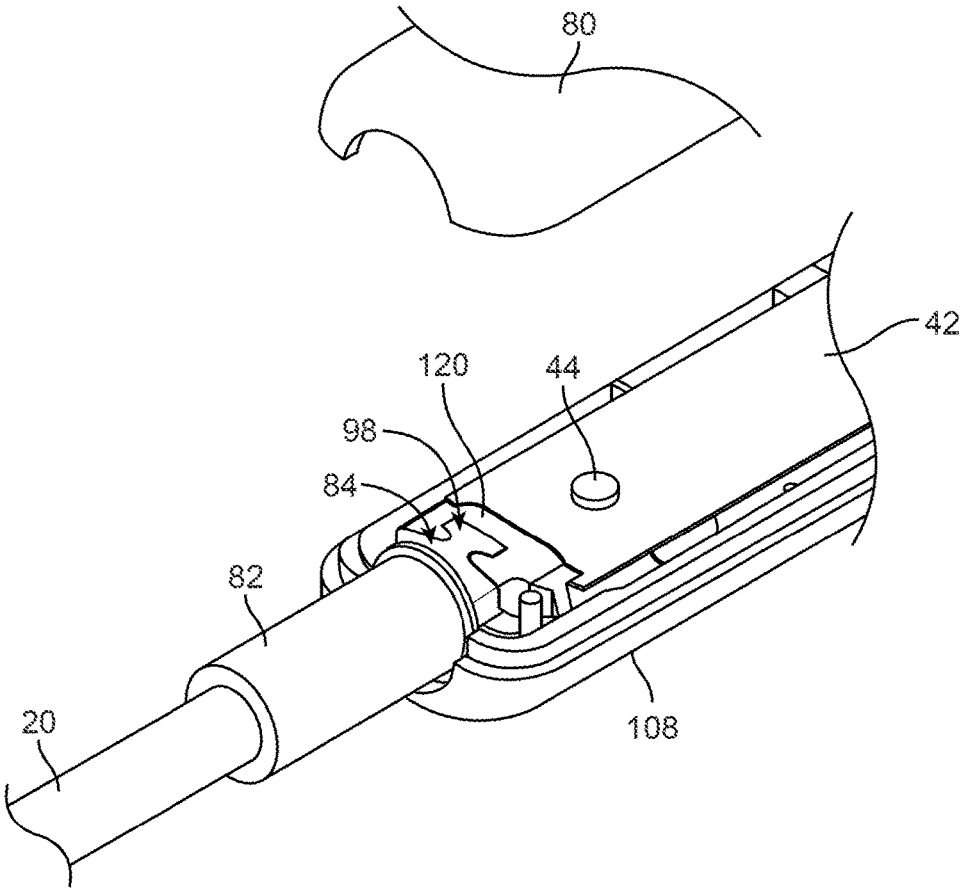
FIG. 29 is a partially exploded front perspective view of the switch module structures of FIG. 28 showing how the switch module structures may be mounted within upper and lower button controller housing structures in accordance with an embodiment of the present invention.

FIG. 29 is a partially exploded front perspective view of the switch module structures of FIG. 28 showing how the switch module structures may be mounted within upper and lower button controller housing structures such as structures 80 and 108.

Figure 30:
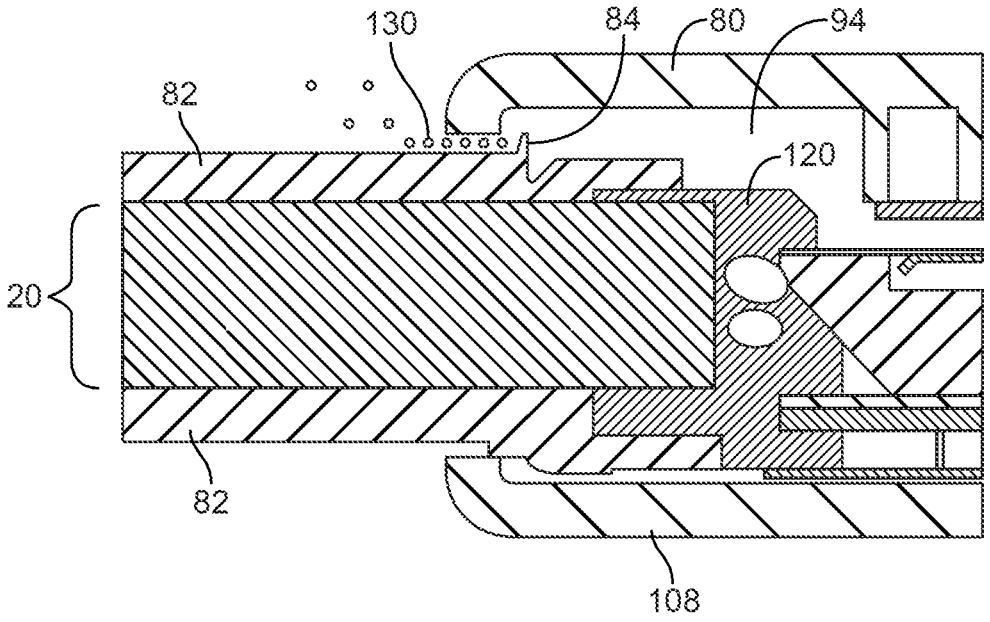
FIG. 30 is a cross-sectional view of an end portion of a button controller showing how a strain relief structure may be used to block intrusion of external material into the interior of the button controller in accordance with an embodiment of the present invention.

FIG. 30 is a cross-sectional view of an end portion of button controller 22 showing how strain relief structure 82 may have a flexible protrusion such as protrusion (lip) 84 for preventing intrusion of external material 130 into interior 94 of the button controller 22.

Figure 31:
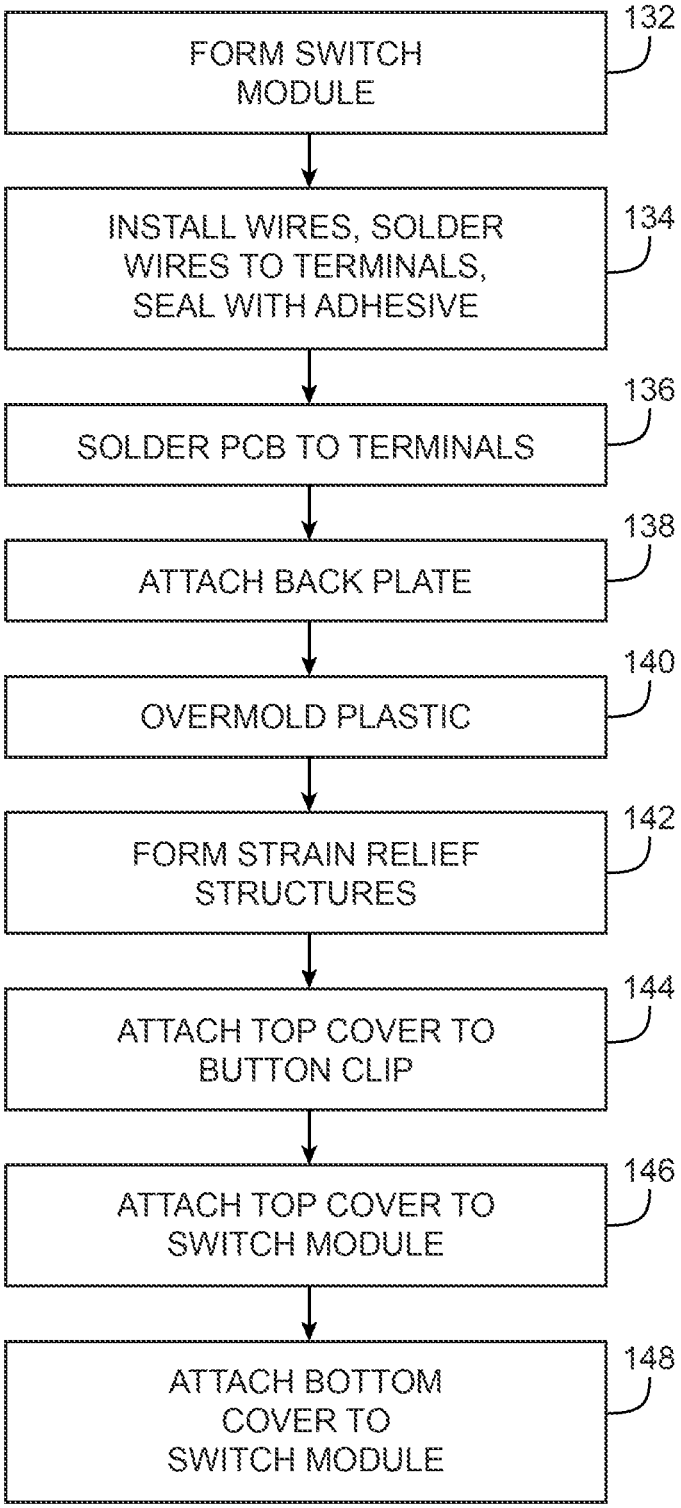
FIG. 31 is a flow chart of illustrative steps involved in forming button controller structures in accordance with an embodiment of the present invention.

A flow chart of illustrative steps involved in forming an accessory button controller is shown in FIG. 31.

At step 132, operations of the type shown in FIG. 16 may be used to form a switch module such as switch module 116 of FIG. 23. Switch module 116 may include a first shot of plastic such as structures 46 that encapsulates switch terminal structures 32 and may have a second shot of plastic that forms structures 52 on structures 46.

At step 134, wires 38 may be installed in switch module 116. For example, wires 38 such as wires G and L of FIG. 2 may be press fit into groove 70 of plastic structures 52 and the tips of wires G2 and M may be soldered to metal structures 32, to form switch module structures 116 of FIG. 24.

At step 136, printed circuit 36 may be soldered to switch terminals 32 to form structures 116 of FIG. 25.

At step 138, backplate 51 may be attached to printed circuit 36 to form structures 116 of FIG. 26.

At step 140, plastic structures 120 may be overmolded over plastic structures 52 and the other structures of switch module 116 of FIG. 27, thereby forming switch module structures 116 of FIG. 28. During the operations of step 138, an interface may be created between backplate 51 and second shot plastic structures 52. Overmold structures 120 may seal this interface between structures 52 and backplate 51. During the overmolding operations of step 140, a material such as polypropylene which is able to readily flow into thin gaps may be used (e.g., a third shot of plastic applied to the structures of module 116 may be polypropylene), thereby helping to form an environmental seal for the interface between structures 52 and 51.

At step 142, strain relief structures (e.g., a fourth shot of plastic) such as structures 82 may be injection molded onto structures 120, thereby forming the inner switch module assembly of FIG. 28.

At step 144, button member 80 may be attached to clip 112 (FIG. 18) by heat staking or other attachment mechanisms.

At step 146, button member 80 may be pressed onto the assembly of FIG. 28, so that openings 118 of clip 112 snap onto snaps 114 on structures 52.

At step 148, bottom button controller housing member 108 may be attached to the assembly of FIG. 28 using heat stakes, pressure sensitive adhesive, and/or other attachment mechanisms, thereby forming the structure of FIG. 29.

The foregoing is merely illustrative of the principles of this invention and various modifications can be made by those skilled in the art without departing from the scope and spirit of the invention.

What is claimed is:

1. An accessory button controller, comprising:

metal switch terminals embedded in at least one plastic structure;

wires soldered to the terminals;

at least one dome switch formed from a dome switch member and portions of the terminals, wherein the at least one plastic structure comprises a first plastic substructure encapsulating the metal switch terminals and a second plastic substructure coupled to the first plastic substructure, wherein the at least one plastic structure comprises a first recess in a first side of the at least one plastic structure configured to receive the dome switch member, a second recess in a second side of the at least one plastic structure configured to receive one or more electrical components, and a third recess configured to receive the wires;

a structure disposed over the second side of the at least one plastic structure, wherein the structure comprises a fourth recess; and a strain relief structure comprising a third plastic substructure disposed at least partially within the fourth recess.

2. The accessory button controller defined in claim 1 further comprising a cable that is received within the strain relief structure, the cable including multiple wires, the multiple wires including the wires that are soldered to the switch terminals.

3. The accessory button controller defined in claim 1 wherein the strain relief structure comprises a fifth recess and a flexible lip positioned between the fifth recess and an end of the movable button member, wherein the movable button member is configured to bear against the flexible lip when the movable button member is pressed.

4. The accessory button controller defined in claim 1 wherein the third recess is in the second side of the at least one plastic structure and extends along a length of the switch module.

5. The accessory button controller defined in claim 1 wherein at least one metal switch terminal extends into the second recess and the wires are soldered to the at least one metal switch terminal in the second recess.

6. The accessory button controller defined in claim 1 further comprising a printed circuit, wherein the one or more electrical components is electrically connected to the printed circuit.

7. The accessory button controller defined in claim 6 further comprising a backplate disposed over the printed circuit and between the second side of the at least one plastic structure and the structure, wherein the backplate forms an interface with the second plastic substructure.

8. The accessory button controller defined in claim 7 wherein the structure comprises a fourth plastic substructure that is coupled to the second plastic substructure and that seals the interface.

9. The accessory button controller defined in claim 1 further comprising:

a movable button member disposed over the switch module, wherein the button member comprises a button disposed over each dome switch; and a clip attached to the movable button member and positioned between the button member and the switch module;

wherein the switch module, the backplate, and the structure are disposed within a housing member and the movable button member is attached to the housing member.

10. The accessory button controller defined in claim 9 wherein the clip includes a first set of engagement features and the switch module includes a second set of engagement features, wherein each engagement feature in the first set of engagement features is configured to mate with a corresponding engagement feature in the second set of engagement features.

11. The accessory button controller defined in claim 10 wherein the first set of engagement features comprise openings and the second set of engagement features comprise switch module protrusions protruding from the switch module.

12. An accessory button controller, comprising:

a first housing component;

a second housing component positioned opposite the first housing component to define an interior volume of a housing; and a plastic structure within the interior volume of the housing;

a first cable segment extending from a first end of the housing and comprising a first strain relief engaged with a first recess in the plastic structure;

a second cable segment extending from a second end of the housing and comprising a second strain relief engaged with a second recess in the plastic structure; and a switch positioned in a third recess in the plastic structure and electrically coupled to at least one of the cable segments; wherein the first housing component is configured to move relative to the second housing component to activate the switch.

13. The accessory button controller defined in claim 12 further comprising a polymer film attached to the plastic structure over the first recess.

14. The accessory button controller defined in claim 12, further comprising metal structures embedded within the plastic structure.

15. The accessory button controller defined in claim 14, further comprising a dome switch member coupled to the plastic structure, wherein the metal structures are configured to form the switch with the dome switch member.

16. The accessory button controller of claim 12, wherein:

the first strain relief is overmolded on the first cable segment;

the second strain relief is overmolded on the second cable segment; and the first and second cable segments extend from opposite ends of the accessory button controller.

17. The accessory button controller of claim 16, wherein the first and second strain reliefs are substantially coaxial with one another.

18. The accessory button controller of claim 17, wherein:

the plastic structure has a substantially elongate shape having a longitudinal axis extending from the first end to the second end; and the first and second cable segments extend from opposite ends of the plastic structure and are substantially coaxial with the longitudinal axis of the plastic structure.

19. A headset, comprising:

a button controller;

a first cable segment extending from a first end of the button controller and comprising a first strain relief proximate the first end of the button controller;

a second cable segment extending from a second end of the button controller and comprising a second strain relief proximate the second end of the button controller;

a speaker coupled to an end of the first cable segment;

a plug coupled to an end of the second cable segment and comprising at least two terminals; wherein the button controller comprises:

a first housing component;

a second housing component positioned opposite the first housing component to define an interior volume of a housing;

a plastic structure within the interior volume of the housing comprising a first recess, a second recess, and a third recess, the first strain relief engaged with the first recess and the second strain relief engaged with the second recess; and a switch positioned in the third recess in the plastic structure, operatively coupled to at least the second cable segment, and configured to selectively electrically connect or disconnect a pair of the at least two terminals;

wherein the first housing component is configured to move relative to the second housing component to activate the switch.

20. The headset of claim 19, wherein the second and third recesses each define an undercut configured to retain the first and second strain reliefs, respectively, to the plastic structure.

21. The headset defined in claim 19 wherein the switch comprises switch terminals embedded in the plastic structure.

22. The headset defined in claim 21 wherein the switch further comprises a dome switch member in the first recess that is configured to form a dome switch with the switch terminals.

23. The headset defined in claim 22 wherein the plastic structure comprises:

a first shot of plastic in which the switch terminals are embedded; and a second shot of plastic on the first shot of plastic.

24. Apparatus, comprising:

switch terminals;

a plastic structure having the switch terminals molded at least partially therein, wherein the plastic structure forms at least one recess;

dome switches that each include a respective dome switch member configured to operatively interact with respective portions of the switch terminals;

a strain relief structure molded into the recess, comprising a flexible lip extending from the strain relief; and a button member configured to bear against the flexible lip when the button member is pressed by a user.

25. The apparatus defined in claim 24 further comprising:

wires in the strain relief structure.

26. The apparatus defined in claim 24, wherein the plastic structure includes a first shot of plastic molded over the switch terminals and a second shot of plastic that has a groove configured to receive wires therein.

* * * * *